US011952552B2

(12) United States Patent
Hardt

(10) Patent No.: US 11,952,552 B2
(45) Date of Patent: Apr. 9, 2024

(54) METAL WORKING FLUID ADDITIVE COMPOSITION

(71) Applicant: Castrol Limited, Reading (GB)

(72) Inventor: Thomas Peter Hardt, Moenchengladbach (DE)

(73) Assignee: Castrol Limited, Reading (GB)

( * ) Notice: Subject to any disclaimer, the term of this patent is extended or adjusted under 35 U.S.C. 154(b) by 0 days.

(21) Appl. No.: 17/973,242

(22) Filed: Oct. 25, 2022

(65) Prior Publication Data

US 2023/0142153 A1 May 11, 2023

Related U.S. Application Data

(63) Continuation of application No. 16/754,119, filed as application No. PCT/EP2018/077052 on Oct. 4, 2018, now Pat. No. 11,499,118.

(30) Foreign Application Priority Data

Oct. 6, 2017 (GB) ..... 17195289

(51) Int. Cl.
*C10M 173/00* (2006.01)
*C10N 40/22* (2006.01)

(52) U.S. Cl.
CPC .... *C10M 173/00* (2013.01); *C10M 2209/084* (2013.01); *C10M 2215/042* (2013.01); *C10M 2223/063* (2013.01); *C10N 2040/22* (2013.01)

(58) Field of Classification Search
CPC ..... C10M 173/00; C10M 2209/084; C10M 2215/042; C10M 2223/063; C10N 2040/22
USPC ..... 508/425
See application file for complete search history.

(56) References Cited

U.S. PATENT DOCUMENTS 5,445,945 A 8/1995 Drechsler
2003/0162671 A1* 8/2003 Kalota ..... C10M 149/20 508/513
2004/0255818 A1* 12/2004 Pawloski ..... C23C 22/50 106/14.13
2009/0036333 A1* 2/2009 Scholier ..... C10M 107/02 508/110
2010/0022425 A1 1/2010 Michael et al.
2010/0093736 A1* 4/2010 Coburn ..... A01N 43/80 507/131
2013/0196893 A1 8/2013 Busby et al.
2017/0009175 A1 1/2017 Anderson et al.

FOREIGN PATENT DOCUMENTS

| | | | |
|---|---|---|---|
| CN | 1514715 | A | 7/2004 |
| CN | 101454429 | A | 6/2009 |
| CN | 102925269 | A | 2/2013 |
| CN | 104277902 | A | 1/2014 |
| CN | 105176656 | A | 12/2015 |
| CN | 105176657 | A | 12/2015 |
| EP | 0787430 | A1 | 8/1997 |
| EP | 2930229 | A1 | 10/2015 |
| JP | 2009073932 | A | 4/2009 |
| JP | 2013076200 | A | 4/2013 |
| JP | 2012076200 | | 4/2014 |
| JP | 2016135840 | A | 7/2016 |
| WO | 2010057973 | A1 | 5/2010 |
| WO | 2015/116233 | A1 | 8/2015 |
| WO | 2017/070140 | A1 | 4/2017 |

OTHER PUBLICATIONS

Brutto, Patrick E., "The Influence of Amine Structure on Performance in MWFs", Tribology & Lubrication Technology, Mar. 2011, pp. 26-32.
The International Search Report (ISR) with Written Opinion for PCT/EP2018/077052 dated Dec. 19, 2018, pp. 1-27.

* cited by examiner

*Primary Examiner* — Prem C Singh
*Assistant Examiner* — Francis C Campanell
(74) *Attorney, Agent, or Firm* — McDonnell Boehnen Hulbert & Berghoff LLP

(57) ABSTRACT

An industrial fluid additive composition comprises one or more sequestering agents one or more compounds of formula (A): (A) wherein $R_1$ and $R_2$ are independently selected from substituted hydrocarbyl moieties containing from 1 to 10 carbon atoms or unsubstituted hydrocarbyl moieties containing from 1 to 10 carbon atoms.

16 Claims, No Drawings

METAL WORKING FLUID ADDITIVE COMPOSITION

This application is a continuation application of U.S. patent application Ser. No. 16/754,119, which is a national stage application under 35 U.S.C. § 371 of International Application No. PCT/EP2018/077052, filed Oct. 4, 2018, which claims priority to European Application No. EP 17195289.8, filed Oct. 6, 2017.

FIELD OF THE INVENTION

The invention relates to metalworking fluids. In particular, the invention relates to an industrial fluid additive composition for use in metalworking fluids, use of such additives, and metalworking fluids comprising such additives.

BACKGROUND OF THE INVENTION

Metalworking fluids (MWFs) are used in workshops worldwide for the cutting and forming of metals. Their main purposes are to cool and lubricate tools, work pieces and machines, inhibit corrosion, remove swarf, and assist in the cutting, grinding and cleaning of metals. There are a variety of different types of metalworking fluids. Metalworking fluids typically fall into one of the following categories: (1) non-water-miscible oils, (2) water-miscible oils, and (3) fully synthetic oil-free products. Non-water-miscible oils typically comprise a base oil (usually over 95%). This can be a mineral oil, ester oil (e.g. unrefined or chemically modified rapeseed oil) or synthetic oil (e.g. poly-alpha-olefin). Water-miscible oil based metalworking fluids are mixed with water before use, typically in water concentrations of 2 to 25% by weight of the metalworking fluid, depending on the product and type of machining. The same types of oils as used in non-water-miscible oil based metalworking fluids may be used. To combine the oil with water to yield an oil-in-water emulsion, an emulsifier is necessary. Fully synthetic oil-free metalworking fluids are water-miscible and free of oils. They do not require emulsifiers. They may comprise compounds such as water-miscible glycol compounds and water.

Microbial growth such as bacterial and fungal growth is generally not a problem for non-water-miscible oil based metalworking fluids. However, for water-miscible oil based metalworking fluids and fully synthetic oil-free metalworking fluids, microbial growth is a problem. In particular, microbial growth is a problem for water-miscible oil based metalworking fluids that comprise both oil and water in the form of an oil-in-water emulsion. Metalworking fluids based on oil-in-water emulsions typically contain a number of components that encourage bacterial and fungal growth, e.g. phosphorus and sulphur containing additives. Micro-organisms can also be imported via the water, floor, air, humans and the work piece itself. The number of micro-organisms that can be tolerated in the metalworking fluid depends on the application in question. Microorganisms can cause degradation of various components of the metalworking fluid, which can negatively affect their functioning. The pH of metalworking fluids based on oil-in-water emulsions is typically from 8.5 to 9.5. Where microorganisms are present in the metalworking fluid, decomposition of various components of the metalworking fluid can increase the carbon dioxide content of the fluid, which decreases its pH. This can lead to increased corrosion of metals that the metalworking fluid comes into contact with in use.

Various methods of inhibiting corrosion in metalworking fluids are known in the art. Most of these include adding a pH increasing additive to the metalworking fluid which increase the pH to an alkaline pH such that corrosion is reduced relative to when the metalworking fluid has a more acidic pH. Such corrosion inhibitors may also raise the pH to a level such that microorganisms present in the metalworking fluid are killed, or raise the pH to a level where further microorganism growth is significantly inhibited. Examples of commonly used corrosion inhibitors in metalworking fluids are amine borate corrosion inhibitors. These are known to provide very good corrosion inhibition and in addition have biocidal activity. The use of such corrosion inhibitors mean that the use of other biocides in the metalworking fluids can be avoided due to the biocidal activity of the amine borates. However, amine borates are known to have a negative environmental impact, cause health hazards, and are generally undesirable in industrial applications. Thus, several amine corrosion inhibitors have been suggested to replace amine borates. These include dicyclohexylamine, 3-amino-4-octanol, monoethanolamine and triethanolamine. The corrosion inhibiting properties of these compounds has previously been believed to be caused solely by their pH increasing effects. The use of such compounds in corrosion inhibition has generally been found to be inferior to amine borates. In addition, cyclohexylamine use is considered unfavourable. Despite being potent biocides, secondary amines such as cyclohexylamine form nitrosamines in the presence of nitrites which are known to be toxic.

Thus, alternative compounds that are good corrosion inhibitors that also inhibit growth of microorganisms in metalworking fluids are desired. EP2930229 discloses a composition comprising acid phosphates and various primary and tertiary amine compounds. The compositions are reported to be good corrosion inhibitors and to inhibit or slow bacterial growth in the metalworking fluids over extended periods of time. Nevertheless, there exists a continued need for compounds and compositions for use in metalworking fluids that impede or inhibit the growth of microorganisms in the metalworking fluids. In particular, there is a continued need for such compounds and compositions that do not comprise a biocide such as a secondary amine additive. As discussed above, such additives may be toxic and many regulations in the field of metalworking fluids now prohibit their usage, or limit their usage to small quantities.

SUMMARY OF THE INVENTION

According to a first aspect of the invention, there is provided an industrial fluid additive composition comprising one or more sequestering agents and one or more compounds of formula (A):

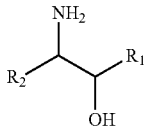

(A)

wherein $R_1$ and $R_2$ are independently selected from substituted hydrocarbyl moieties containing from 1 to 10 carbon atoms or unsubstituted hydrocarbyl moieties containing from 1 to 10 carbon atoms.

According to a second aspect of the invention, there is provided a metalworking fluid comprising an industrial fluid additive composition according to the first aspect of the invention.

According to a third aspect of the invention, there is provided the use of an industrial fluid additive composition according to the first aspect of the invention to inhibit microbial growth such as inhibiting the growth of bacteria or fungi. Preferably, the use comprises using the industrial additive composition according to the first aspect of the invention in a metalworking fluid according to the second aspect of the invention.

According to a fourth aspect of the invention, there is provided a method of cutting, grinding or cleaning a metal comprising applying a metalworking fluid according to the second aspect of the invention to said metal.

DETAILED DESCRIPTION OF THE INVENTION

The present invention is based on the finding that an industrial fluid additive composition according to the first aspect of the invention has unexpectedly been found to have a surprisingly good potency in inhibiting the growth of microorganisms in metalworking fluids. This potency in inhibiting the growth of microorganisms in metalworking fluids has been found to be associated with the use of a compound of formula (A) in combination with one or more sequestering agents. The potency of an additive composition of the invention in inhibiting the growth of microorganisms in metalworking fluids has been found to be synergistic in comparison to the potency in inhibiting the growth of microorganisms of compositions comprising one or more sequestering agents but no compound of formula (A), and in comparison to compositions comprising a compound of formula (A) but no sequestering agents. Compositions comprising the compound of formula (A) only, and no sequestering agent have previously been found to have a slight effect in inhibiting the growth of fungi, but to have no effect on bacterial growth. Compositions comprising only sequestering agents and no compound of formula (A) have not previously been found to have any effect on the growth of microorganisms.

Without being limited by theory, it is believed that the unexpected potency of compositions of the invention in inhibiting the growth of microorganisms in metalworking fluids is attributed to the following factors. The compound of formula (A) is sufficiently basic that the pH of the metalworking fluid is increased. The increase in pH of the metal working fluid impedes the growth of microorganisms in the metal working fluid which generally grow better at neutral pH values. It is also believed that having an —NH 2 moiety bonded to a carbon atom which is adjacent to a carbon atom bonded to the OH moiety in the compound of formula (A) is important. It is believed that such a moiety in the molecule is particularly useful in metalworking fluids that are oil-in-water emulsions because the moiety aids in the compound of formula (A) being present at the micelle boundary. The one or more sequestering agents present in the additive composition of the invention are believed to chelate any metal ions present in the metalworking fluid. The presence of metal ions promotes microbiological growth since the metal ions are involved in the metabolism of microorganisms. The one or more sequestering agents chelate the metal ions meaning that any microorganisms present are unable to absorb the metal ions present in solution and use them in their metabolism for growth. As such, the presence of one or more sequestering agents in the additive composition may inhibit the growth of microorganisms present in the metal working fluid.

The additive compositions of the invention may comprise an additional biocidal component such as a secondary amine (e.g. dicyclohexylamine). However, it has been found that the combination of compounds of formula (A) with one or more sequestering agents is sufficient to inhibit the growth of microorganisms in metalworking fluids such that a biocide such as dicyclohexylamine is not necessary to include in the additive composition. Accordingly, in a preferable embodiment, the additive compositions of the invention do not comprise biocides. In another preferable embodiment, the compositions of the invention do not comprise secondary amines (e.g. dicyclohexylamine).

The term biocide as used herein is used to refer to a component of an additive composition or metalworking fluid that directly kills microorganisms present in the fluid. Likewise, the terms bacteriocide and fungicide are used to refer to components of a composition that directly kill bacteria and fungi respectively. Examples of such biocidal components include secondary amines such as dicyclohexylamine, orthophenylphenol, methylisothiazolinone, benzisothiazolinon and N-(3-aminopropyl)-N-dodecylpropane-1,3-diamine. Generally, for reasons such as toxicity, there are stringent regulations in place regarding the use of biocides in metalworking fluids. As such, it would be advantageous to provide an additive composition for a metalworking fluid that inhibits the growth of microorganisms present in the metalworking fluid, but where the additive composition itself is not biocidal. Such advantages are provided by additive compositions of the invention that can inhibit the growth of microorganisms in metalworking fluids, but without being biocidal and directly killing the microorganisms present. If the industrial fluid additive compositions of the invention are added to metalworking fluids already comprising microorganisms, the additive compositions of the invention may act to decrease the microorganism population of the metal working fluid. This is because the environment of the metalworking fluid may be altered by the presence of the additive such that microorganisms can no longer grow in it, and consequently die. For example, as explained above, the one or more sequestering agents may prevent the microorganisms taking up dissolved metal ions which they require for their metabolism, consequently causing the microorganism to die. As such, the industrial fluid additive compositions of the invention may indirectly act to kill the microorganisms in the metalworking fluid by altering the environment of the metalworking fluid such that it is inhospitable to microbial life. Such activity is distinguished from that of biocides where the biocide molecule acts directly to kill the microorganisms present, for example by being toxic to the microorganism.

The compound of formula (A) present in the industrial fluid additive compositions of the present invention has the following formula:

(A)

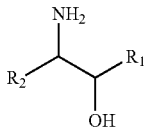

wherein $R_1$ and $R_2$ are independently selected from substituted hydrocarbyl moieties containing from 1 to 10 carbon atoms or unsubstituted hydrocarbyl moieties containing from 1 to 10 carbon atoms.

$R_1$ and $R_2$ may be independently selected from substituted or unsubstituted aliphatic or aromatic hydrocarbyl moieties such as alkyl moieties, alkenyl moieties, alkynyl moieties, cycloalkyl moieties, cycloalkenyl moieties, aryl moieties, alkaryl moieties and aralkyl moieties. Preferably, $R_1$ and $R_2$ comprise aliphatic hydrocarbyl moieties. More preferably, $R_1$ and $R_2$ comprise alkyl moieties. $R_1$ and $R_2$ may comprise linear or branched alkyl moieties or cycloalkyl moieties. Preferably, $R_1$ and $R_2$ comprise linear alkyl moieties. Where two or more moieties are described as being "each independently" selected from a list of moieties, this means that the moieties may be the same or different. The identity of each moiety is therefore independent of the identities of the one or more other moieties. Where multiple substituents are indicated as being attached to a structure, it will be understood that the substituents can be the same or different.

The term "hydrocarbyl" as used herein refers to a group consisting exclusively of hydrogen and carbon atoms, the group having from 1 to 30 carbon atoms. For instance, a hydrocarbyl group may have from 1 to 20 carbon atoms, e.g. from 1 to 12 carbon atoms, e.g. from 1 to 10 carbon atoms. A hydrocarbyl group may be an acyclic group, a cyclic group, or may comprise both an acyclic portion and a cyclic portion. Examples of hydrocarbyl groups include alkyl, alkenyl, alkynyl, carbocyclyl (e.g. cycloalkyl, cycloalkenyl or aryl) and aralkyl.

The term "alkyl" as used herein refers to a straight or branched chain alkyl moiety having from 1 to 30 carbon atoms. For instance, an alkyl group may have from 1 to 20 carbon atoms, e.g. from 1 to 12 carbon atoms, e.g. from 1 to 10 carbon atoms. In particular, an alkyl group may have 1, 2, 3, 4, 5 or 6 carbon atoms. Examples of alkyl groups include methyl, ethyl, propyl (n-propyl or isopropyl), butyl (n-butyl, sec-butyl or tert-butyl), pentyl, hexyl and the like.

The term "alkenyl" as used herein refers to a straight or branched chain alkyl group having from 2 to 30 carbon atoms and having, in addition, at least one carbon-carbon double bond, of either E or Z stereochemistry where applicable. For instance, an alkenyl group may have from 2 to 20 carbon atoms, e.g. from 2 to 12 carbon atoms, e.g. from 2 to 10 carbon atoms. In particular, an alkenyl group may have 2, 3, 4, 5 or 6 carbon atoms. Examples of alkenyl groups include ethenyl, 2-propenyl, 1-butenyl, 2-butenyl, 3-butenyl, 1-pentenyl, 2-pentenyl, 3-pentenyl, 1-hexenyl, 2-hexenyl, 3-hexenyl and the like.

The term "alkynyl" as used herein refers to a straight or branched chain alkyl group having from 2 to 30 carbon atoms and having, in addition, at least one carbon-carbon triple bond. For instance, an alkynyl group may have from 2 to 20 carbon atoms, e.g. from 2 to 12 carbon atoms, e.g. from 2 to 10 carbon atoms. In particular, an alkynyl group may have 2, 3, 4, 5 or 6 carbon atoms. Examples of alkynyl groups include ethynyl, 1-propynyl, 2-propynyl, 1-butynyl, 2-butynyl, 3-butynyl, 1-pentynyl, 2-pentynyl, 3-pentynyl, 1-hexynyl, 2-hexynyl, 3-hexynyl and the like.

The term "cycloalkyl" as used herein refers to an aliphatic carbocyclic moiety having from 3 to 20 ring carbon atoms. For instance, a cycloalkyl group may have from 3 to 16 carbon atoms, e.g. from 3 to 10 carbon atoms. In particular, a cycloalkyl group may have 3, 4, 5 or 6 ring carbon atoms. A cycloalkyl group may be a monocyclic, polycyclic (e.g. bicyclic) or bridged ring system. Examples of cycloalkyl groups include cyclopropyl, cyclobutyl, cyclopentyl, cyclohexyl, norbornyl and the like.

The term "cycloalkenyl" as used herein refers to an aliphatic carbocyclic moiety having from 5 to 20 ring carbon atoms and having, in addition, at least one carbon-carbon double bond in the ring. For instance, a cycloalkenyl group may have from 5 to 16 carbon atoms, e.g. from 5 to 10 carbon atoms. In particular, a cycloalkenyl group may have 5 or 6 ring carbon atoms. A cycloalkenyl group may be a monocyclic, polycyclic (e.g. bicyclic) or bridged ring system. Examples of cycloalkenyl groups include cyclopentenyl, cyclohexenyl and the like.

The term "aryl" as used herein refers to an aromatic carbocyclic ring system having from 6 to 30 ring carbon atoms. For instance, an aryl group may have from 6 to 16 ring carbon atoms, e.g. from 6 to 10 ring carbon atoms. An aryl group may be a monocyclic aromatic ring system or a polycyclic ring system having two or more rings, at least one of which is aromatic. Examples of aryl groups include phenyl, naphthyl, fluorenyl, azulenyl, indenyl, anthryl and the like.

The term "aralkyl" as used herein refers to an alkyl group substituted with an aryl group, wherein the alkyl and aryl groups are as defined herein. An example of an aralkyl group is benzyl.

The term "alkaryl" as used herein refers to an aryl group substituted with an alkyl group, wherein the alkyl and aryl groups are as defined herein. An example of an alkaryl group is methylphenyl.

$R_1$ and $R_2$ may comprise substituted or unsubstituted hydrocarbyl moieties. The term "substituted" as used herein in connection with a chemical group means that one or more (e.g. 1, 2, 3, 4 or 5) of the hydrogen atoms in that group are replaced independently of each other by a corresponding number of substituents. It will, of course, be understood that the one or more substituents may only be at positions where they are chemically possible, i.e. that any substitution is in accordance with permitted valence of the substituted atom and the substituent, and that the substitution results in a stable compound. The term is contemplated to include all permissible substituents of a chemical group or compound. It will be understood by those skilled in the art that one or more hydrogen atoms on a given substituent can themselves be substituted, if appropriate. Non-limiting examples of substituents include moieties such as —OH, —$NH_2$, —Cl, —Br, —F, —$CO_2H$, —$CO_2R_x$, —$COR_x$, —CONH—$R_x$, wherein $R_x$ is substitute or unsubstituted hydrocarbyl.

Preferably, $R_1$ and $R_2$ independently selected from unsubstituted alkyl groups, and more preferably unsubstituted linear alkyl groups.

$R_1$ and $R_2$ each have from 1 to 10 carbon atoms. Preferably, $R_1$ and $R_2$ each have from 1 to 5 carbon atoms. Preferably, the compound of formula (A) comprises from 5 to 12 carbon atoms in total. Thus, in a preferred embodiment, $R_1$ and $R_2$ each have from 1 to 5 carbon atoms and the compound of formula (A) comprises from 5 to 12 carbon atoms in total. In a highly preferred embodiment, $R_1$ is n-butyl and $R_2$ is ethyl. This is the compound 3-amino-4-octanol. Without being limited by theory, it is believed to be advantageous for the compound of formula (A) to comprise from 5 to 12 carbon atoms in total with $R_1$ and $R_2$ each having from 1 to 5 carbon atoms because this is optimal for allowing the compound of formula (A) to be present at the micelle boundary in an oil-in-water emulsion, along with the molecule comprising an —$NH_2$ moiety bonded to a carbon atom which is adjacent to a carbon atom bonded to the OH moiety as discussed above.

The compound of formula (A) can be present in the industrial fluid additive composition of the invention in any suitable amount. For example, the compound of formula (A) can be present in an amount of from 10% to 50% by weight of the industrial fluid additive composition. Preferably, the compound of formula (A) is present in an amount of from 15% to 35% by weight of the industrial fluid additive composition.

The industrial fluid additive composition of the invention comprises one or more sequestering agents. Any known suitable sequestering agent or chelating agent known to effectively chelate dissolved metal ions in aqueous solution or in oil-in-water emulsions may be used. Sequestering agents that may be used in additive compositions of the present invention include compounds comprising one or more phosphonate moieties in the molecule. Other examples of sequestering agents for use in accordance with the invention include polyacrylates, polyacrylic acids, polylactates, compounds comprising two or more carboxyl groups such as ethylenediaminetetraacctic acid (EDTA), methylglycinediacetic acid (MGDA), nitrilotriacetic acid, succinimides, or any combination thereof.

Preferably, the one or more sequestering agents comprise a compound comprising one or more phosphonate moieties. More preferably, the one or more sequestering agents comprise a compound of formula (B):

(B)

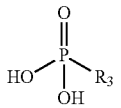

wherein $R_3$ is a substituted hydrocarbyl group containing from 1 to 10 carbon atoms, or an unsubstituted hydrocarbyl group containing from 1 to 10 carbon atoms. Preferably, $R_3$ is a substituted alkyl group containing from 1 to 10 carbon atoms, or an unsubstituted alkyl group containing from 1 to 10 carbon atoms.

Preferably, $R_3$ is a substituted alkyl group comprising from 1 to 10 carbon atoms. More preferably, wherein $R_3$ is a substituted alkyl group comprising one or two phosphonate moieties such as a substituted $C_1$ or $C_2$ alkyl group containing one or two phosphonate moieties. Most preferably, $R_3$ is a substituted $C_1$ to $C_2$ alkyl group containing one or two phosphonate moieties, and one or more hydroxyl moieties. In a highly preferable embodiment, the compound of formula (B) is selected from 1-hydroxethane 1, 1-diphosphonic acid, aminotris(methylenephosphonic acid), or a combination thereof.

The one or more sequestering agents may be present in the industrial fluid additive composition of the invention in any suitable amount. For example, the one or more sequestering agents may be present in an amount of at least 5% by weight of the industrial fluid additive composition, such as in an amount of from 5% to 20% by weight of the industrial fluid additive composition.

Where the one or more sequestering agents comprise one or more phosphonate groups, it is believed that at least a fraction of the compound of formula (A) and at least a fraction of the one or more sequestering agents react in situ upon formation of the composition so as to form an ammonium phosphonate salt. Without being limited by theory, it is believed that the formation of this salt contributes to the unexpectedly good potency of the composition in inhibiting growth of microorganisms in metalworking fluids. Additionally, the in situ formation of the salt extends the shelf life of the additive composition due to the salt's stability.

The industrial fluid additive composition of the invention typically comprises water. The water may be present in any suitable amount. For example, the water may be present in an amount of from 20% to 80%, and preferably from 30% to 60% by weight of the industrial fluid additive composition.

The pH of the industrial fluid additive composition is typically in the range of from 7 to 11. Preferably, the pH of the additive composition is from 8 to 10.5, more preferably from 8.5 to 10, and most preferably from 9 to 9.5. Without being limited by theory, a pH within the range of from 9 to 9.5 is preferred since such a pH has been found to be sufficiently high to contribute towards the inhibition of microbial growth in the metalworking fluid. Surprisingly, the industrial fluid additive compositions of the invention have been found to be effective at inhibiting the growth of microorganism in metalworking fluids at lower pH than known additives for inhibiting microbial growth. Without being limited by theory, this is believed to be linked to the synergy discussed above associated with using the one or more sequestering agents and compound of formula (A) in the additive compositions of the invention. Sufficiently inhibiting the growth of microorganisms at lower pH is advantageous because it means that the composition works just as well but in a less caustic environment.

The industrial fluid additive compositions of the invention may further comprise a pH increasing additive. Examples of pH increasing additives include $C_1$ to $C_{10}$ primary alkyl amines such as monoethanolamine Other examples of pH increasing additives include triethanolamine. The pH increasing additive may be present in the additive composition in any suitable amount sufficient for the pH of the additive composition to be raised within a desirable range, such as the ranges discussed above. Typically, the pH increasing additive is present in the additive composition in an amount of from 2 to 25% by weight of the additive composition, and preferably in an amount of from 5% to 15% by weight of the additive composition.

The industrial fluid additive compositions of the present invention may also comprise other components known in the art suitable for use in metalworking fluids and additive compositions for use in metal working fluids. Such components will be known to the person skilled in the art. For example, the additive compositions of the invention may further comprise one or more surfactants. The one or more surfactants may be present in any suitable amount. Typically, the one or more surfactants are present in the additive composition in an amount of from 1% to 10% by weight of the additive composition, such as from 2% to 6% by weight of the additive composition.

The present invention also provides metal working fluids comprising an industrial fluid additive composition of the present invention. The metal working fluids according to the invention may be any type of metalworking fluid known in the art such as: (1) non-water-miscible oils, (2) water-miscible oils, and (3) fully synthetic oil-free products. Accordingly, the metalworking fluids may be oil based, aqueous based, a water-in-oil emulsion, or an oil-in-water emulsion. Preferably, the metalworking fluid of the present invention is based on a water-miscible oil or is a fully synthetic oil-free product. Most preferably, the metalworking fluid is based on a water-miscible oil. Such metalworking fluids will typically comprise water and an oil such as a mineral oil, a synthetic oil or an ester oil. The metalworking fluid may also comprise an emulsifier to aid in formation of the oil-in-water emulsion or water-in-oil emulsion. Preferably, the metalworking fluid of the invention is an oil-in-water emulsion. Preferably, the oil-in-water emulsion comprises an emulsifier.

The metalworking fluids of the invention may further comprise one or more additives such as those typically found in metal working fluids. Such additives will be known and familiar to the person skilled in the art.

The metalworking fluids of the invention may comprise the industrial fluid additive compositions of the invention in any suitable amount. Typically, metalworking fluids of the invention will comprise the industrial fluid additive compositions of the invention in an amount sufficient for achieving the effect of inhibition of microbiological growth. Typically, the metalworking fluids of the invention comprise the industrial fluid additive composition of the invention in an amount of from 0.1% to 10% by weight, preferably from 0.1% to 5% by weight, and most preferably from 0.5% to 1.5% by weight.

Accordingly, the metalworking fluids of the invention may comprise one or more sequestering agents. Typically, the one or more sequestering agents are present in the metalworking fluids in an amount of at least 0.01% by weight, such as from 0.01% to by weight of the metalworking fluid. The metalworking fluids of the invention will also comprise one or more compounds of formula (A). Typically, the one or more compounds of formula (A) are present in an amount of from 0.1% to 0.5%, and preferably from 0.15% to 0.35% by weight of the metalworking fluid.

The pH of the metalworking fluid may be any suitable pH for a metalworking fluid. A particular pH value of the metalworking fluid may be chosen by the person skilled in the art for a particular application. Typically, the pH of the metalworking fluid is 8 to 10.5, more preferably 8.5 to 10, and most preferably 9 to 9.5. Such a pH is believed to be optimal since it allows for inhibition of microbiological growth without being too caustic. An advantage of the metalworking fluids of the invention is that microbiological growth in the fluids is sufficiently inhibited at pH 9 to 9.5. Various previously known metalworking fluids not according to the invention require higher pH values in order to sufficiently inhibit microbiological growth.

The present invention also provides for the use of industrial fluid additive compositions of the invention in inhibiting microbial growth such as inhibiting the growth of bacteria and/or fungi. Use according to the invention may comprise using the additive of the invention in any industrial fluid where the inhibition of microbiological growth is desired or necessary. Preferably, use according to the invention comprises using the industrial fluid additive composition to inhibit the growth of microorganisms in a metalworking fluid.

The present invention also provides a method of using the metalworking fluids of the invention in metalworking applications. The metalworking applications may comprise any known application for a metalworking fluid known to the skilled person. Preferably, the method of the invention comprises a method of cutting, grinding or cleaning a metal comprising applying a metalworking fluid of the invention.

EXAMPLES

The following test formulations were prepared by mixing the respective ingredients in the amounts indicated in the table.

| Formulation | Test series 1 SCL-003 | Test series 1 SCL-008 | Test series 2 SCL-017 | Test series 3 SCL-003 | Test series 3 SCL-019 | Test series 3 SCL-021 | Test series 3 SCL-026 |
|---|---|---|---|---|---|---|---|
| Deionised water | 45.5 | 45.50 | 35.5 | 45.50 | 45.50 | 31.50 | 33.50 |
| Triton DF12 | 2.00 | 2.00 | 2.00 | 2.00 | | | |
| Corrguard EXT | 25.00 | | 25.00 | 25.00 | 25.00 | 25.00 | 25.00 |
| Monoethanol-amine | 8.00 | 8.00 | 8.00 | 8.00 | 8.00 | 8.00 | 8.00 |
| Lubrophos LB400E | 2.00 | 2.00 | | 2.00 | 2.00 | 2.00 | 2.00 |
| HEDP-60 | 17.50 | 17.50 | 2.00 | 17.50 | | | |
| Caprylic acid | | | 27.50 | | | | |
| Sebacinic acid | | | | | 19.50 | | |
| Neodecanoic acid | | | | | | 33.50 | |
| Isononoic acid | | | | | | | 31.50 |
| Dicyclohexylamine | | 25.00 | | | | | |
| Total | 100 | 100 | 100 | 100 | 100 | 100 | 100 |

| Formulation | Test series 4 SCL-003 | Test series 4 SCL-029 | Test series 4 SCL-DF12 | Test series 4 SCL-EXT | Test series 4 SCL-MEA | Test series 4 SCL-LB400 | Test series 4 SCL-HEDP |
|---|---|---|---|---|---|---|---|
| Deionised water | 45.5 | 57.5 | 98.00 | 75.00 | 92.00 | 98.00 | 82.50 |
| Triton DF12 | 2.00 | | 2.00 | | | | |
| Corrguard EXT | 25.00 | 25.00 | | 25.00 | | | |
| Monoethanol-amine | 8.00 | | | | 8.00 | | |
| Lubrophos LB400E | 2.00 | | | | | 2.00 | |

-continued

| | | | | | | | |
|---|---|---|---|---|---|---|---|
| HEDP-60 | 17.50 | 17.50 | | | | | 17.50 |
| Caprylic acid | | | | | | | |
| Sebacinic acid | | | | | | | |
| Neodecanoic acid | | | | | | | |
| Isononoic acid | | | | | | | |
| Total | 100 | 100 | 100 | 100 | 100 | 100 | 100 |

In the above test formulations, Triton DF-12 and Lubrophos LB400E are commercially available surfactants.

Corrguard EXT is the compound 3-amino-4-octanol (an example compound of a compound of formula (A)).

HEDP-60 is the compound 1 hydroxyethane 1,1-diphosphonic acid, and example of a sequestering agent.

The values given in the table above are percentages by weight of the industrial fluid additive composition.

The above industrial fluid additive compositions were all mixed into oil-in-water emulsion metalworking fluids in an amount of 1% by weight of the metalworking fluid. Each metal working fluid was tested over a time period for the amount of bacteria and fungi present in the metalworking fluid.

Test Series 1

| | Bacteria 24 H | Bacteria 48 H | Bacteria 96 H | Fungi 24 H | Fungi 48 H | Fungi 96 H |
|---|---|---|---|---|---|---|
| SCL-003 | 4 × 10^1 | 0 | 0 | 3 × 10^1 | 0 | 0 |
| SCL-008 | 0 | 0 | 0 | 0 | 0 | 0 |
| Control fluid (no industrial fluid additive composition | 6.4 × 10^7 | 5.84 × 10^7 | 9.28 × 10^7 | 2.0 × 10^4 | 7.6 × 10^4 | 1.6 × 10^4 |

In test series 1, the above values for bacterial and fungal content are in cfu/ml. The initial values at Time=0 were bacteria: 3.44×10^9 cfu/ml and fungi: 1×10^5 cfu/ml. The pH after 48 hours of the metalworking fluids was 8.7 for SCL-003, 8.6 for SCL-008 and 8.1 for the control fluid.

Test series 2

| | Bacteria 24 H | Bacteria 48 H | Bacteria 96 H | Fungi 24 H | Fungi 48 H | Fungi 96 H |
|---|---|---|---|---|---|---|
| SCL-017 | 10^4 – 10^5 | 4.16 × 10^5 | 1.21 × 10^5 | 0 | 0 | 0 |
| Control fluid (no industrial fluid additive composition | 2.68 × 10^7 | 1.76 × 10^7 | 2 × 10^7 | 9 × 10^2 | 1 × 10^3 | 1 × 10^3 |

In test series 2, the above values for bacterial and fungal content are in cfu/ml. The initial values at Time=0 were bacteria: 1.72×10 ^7 cfu/ml and fungi: 1×10^3 cfu/ml.

Test series 3

| | Bacteria 24 H | Bacteria 48 H | Bacteria 96 H | Fungi 24 H | Fungi 48 H | Fungi 96 H |
|---|---|---|---|---|---|---|
| SCL-003 | 9 × 10^3 | 5 × 10^3 | 6 × 10^1 | 1.4 × 10^2 | 0 | 0 |
| SCL-019 | >10^5 | >10^5 | >10^5 | 0 | 1 × 10^1 | 0 |
| SCL-021 | >10^5 | >10^5 | >10^5 | 0 | 0 | 0 |

-continued

| Test series 3 | | | | | | |
|---|---|---|---|---|---|---|
| | Bacteria 24 H | Bacteria 48 H | Bacteria 96 H | Fungi 24 H | Fungi 48 H | Fungi 96 H |
| SCL-026 | >10^5 | >10^5 | >10^5 | 5 × 10^1 | 5 × 10^1 | 0 |
| Control fluid (no industrial fluid additive composition | 3.76 × 10^7 | 3.6 × 10^7 | 2.8 × 10^7 | 3.8 × 10^4 | 1.9 × 10^4 | 1 × 10^5 |

In test series 3, the above values for bacterial and fungal content are in cfu/ml. The initial values at Time=0 were bacteria: 3.44×10^9 cfu/ml and fungi: 1×10^5 cfu/ml.

| Test series 4 | | | | | | |
|---|---|---|---|---|---|---|
| | Bacteria 24 H | Bacteria 48 H | Bacteria 96 H | Fungi 24 H | Fungi 48 H | Fungi 96 H |
| SCL-003 | 4 × 10^1 | 0 | 0 | 0 | 0 | 0 |
| SCL-029 | 8 × 10^3 | 7 × 10^3 | 1× 10^3 | 1 × 10^1 | 0 | 0 |
| SCL-DF12 | >10^5 | >10^5 | >10^5 | 5 × 10^1 | 4 × 10^1 | 6 × 10^1 |
| SCL-EXT | 5.04 × 10^5 | 1.06 × 10^5 | 2 × 10^1 | 0 | 0 | 0 |
| SCL-MEA | 5.36 × 10^5 | 4.00 × 10^5 | 8.1 × 10^4 | 5 × 10^1 | 9 × 10^1 | 1.1 × 10^2 |
| SCL-LB400 | >10^5 | >10^5 | >10^5 | 6 × 10^1 | 1 × 10^1 | 1 × 10^1 |
| SCL-HEDP | >10^5 | >10^5 | >10^5 | 8 × 10^1 | 1.2 × 10^2 | 6 × 10^1 |
| Control fluid (no industrial fluid additive composition | 1.12×10^7 | 1.12 × 10^7 | 8.8 × 10^6 | 7 × 10^1 | 3 × 10^1 | 5 × 10^1 |

In test series 4, the above values for bacterial and fungal content are in cfu/ml. The initial values at Time=0 were bacteria: 5.6×10^6 cfu/ml and fungi: 9×10^1 cfu/ml.

Discussion of Results

The results of test series 1 demonstrate that a metalworking fluid comprising an additive of the invention (i.e. comprising both a sequestering agent and a compound of formula (A) inhibited the growth of bacteria and fungi after 48 hours. The additive of the invention is shown to alter the environment of the metalworking fluid such that it becomes inhospitable to microbial life such that any microorganisms present die. In contrast, in the control formulation which did not contain an additive of the invention, fungi and bacteria levels remained similar over 96 hours. The results also show that an industrial fluid additive of the invention (SCL-003), and that is free of biocides and secondary amines is just as good at inhibiting growth of microorganisms as a metalworking fluid comprising the biocide dicyclohexylamine.

The results of test series 2 show that the formulation SCL-017 reduces the bacterial population of a metalworking fluid over 96 hours. This is in contrast to the control formulation where bacterial and fungal levels remained constant. SCL-017 is an industrial fluid additive composition according to the invention. However, it contains a very low level of sequestering agent compared to the SCL-003 formulation of test series 1. As expected, whilst SCL-017 acted to decrease the bacterial population, this decrease was a lot less than SCL-003 in test series 1 which comprised a much higher quantity of sequestering agent.

The results of test series 3 compared an example industrial fluid additive composition of the invention (SCL-003) comprising a sequestering agent, a compound of formula (A) and a monoethanolamine pH booster with corresponding formulations SCL-019, SCL-021 and SCL-026 which comprised the same amount of the compound of formula (A), the same amount of monoethanolamine, but no sequestering agent. Each of SCL-019, SCL-021 and SCL-026 also contained fatty acid. This was to adjust the pH of all four test formulations to similar values. It was necessary to add the fatty acid to SCL-019, SCL-021 and SCL-026 because so as to lower the pH such that it was comparable to that of SCL-003. Without the fatty acid present, the pII of these formulations would be higher owing to the absence of the acidic HEDP-60 sequestering agent. The results show that over time, the additive of the invention reduced both the bacterial and fungal populations of the metalworking fluid. In contrast, SCL-019 and SCL-026 reduced the fungal population very slightly, but to a significantly lower extent that SCL-003. SCL-021 did not affect the fungal population since the population at time=zero was zero. Each of SCL-019, SCL-021 and SCL-026 did not reduce the bacterial population of the metalworking fluid at all.

The results of test series 4 show that control samples SCL-DF12 and SCL-LB400 which contain only deionised water and surfactant have very little effect on bacterial and fungal populations. The results also show that SCL-HEDP containing only sequestering agent has very little effect on both bacterial and fungal populations. SCL-MEA which contained only water and monoethanolamine was shown to slightly reduce bacterial population over time, but have no effect on fungal population. SCL-EXT which contained only the compound of formula (A) is shown to slightly reduce both bacterial and fungal populations.

In contrast, formulations SCL-003 and SCL-029 according to the invention significantly reduced both bacterial and fungal populations over time. SCL-003 was better than all other tested formulations in reducing both bacterial and fungal populations. SCL-003 reduced both bacterial and fungal populations more than SCL-029 because SCL-029 did not contain any monoethanolamine which increases the pH of the formulation, thus increasing its potency in inhibiting growth of microorganism. This also explains why the SCL-EXT formulation showed a higher antibacterial effect than SCL-029. SCL-EXT contains only the compound of formula (A) and water, so will have a much higher pH than SCL-029 which contains both the basic compound of formula (A) and the acidic HEDP.

The invention claimed is:

1. An industrial fluid additive composition comprising:

one or more sequestering agents, present in an amount of at least 5% by weight of the composition, wherein each of the one or more sequestering agents is a compound of formula (B):

(B)

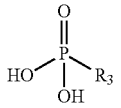

wherein $R_3$ is a substituted hydrocarbyl group comprising one or two carbon atoms and one or two phosphonate moieties; and one or more compounds of formula (A):

(A)

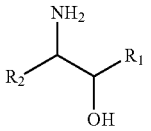

present in amounts in the range of from 10% to 50% by weight of the composition;

wherein $R_1$ and $R_2$ are independently selected from unsubstituted alkyl moieties containing from 1 to 5 carbon atoms, and wherein the compound of formula (A) contains from 5 to 12 carbon atoms; and wherein the composition does not comprise a biocide.

2. The industrial fluid additive composition according to claim 1, wherein $R_1$ and $R_2$ are linear alkyl moieties.

3. The industrial fluid additive composition according to claim 1, wherein $R_1$ is n-butyl and $R_2$ is ethyl.

4. The industrial fluid additive composition according to claim 1, wherein the one or more sequestering agents are selected from 1-hydroxethane 1,1-diphosphonic acid, aminotris(methylenephosphonic acid), or a combination thereof.

5. The industrial fluid additive composition according to claim 1, wherein at least a fraction of the compound of formula (A) and at least a fraction of the one or more sequestering agents are present in the composition in the form of an ammonium phosphonate salt.

6. The industrial fluid additive composition according to claim 1, wherein the pH of the composition is from 8 to 10.5.

7. The industrial fluid additive composition according to claim 1, wherein the compound of formula (A) is present in the composition in an amount of from 15% to 35% by weight of the composition; and the one or more sequestering agents are present in an amount of from 5% to 20% by weight of the composition.

8. The industrial fluid additive composition according to claim 7, wherein the composition further comprises water, present in an amount of from 30% to 60% by weight of the composition.

9. The industrial fluid additive composition according to claim 1, further comprising one or more surfactants.

10. A metalworking fluid comprising an industrial fluid additive composition according to claim 1.

11. The metalworking fluid according to claim 10, wherein the one or more compounds of formula (A) are present in the metalworking fluid in an amount of from 0.1% to 0.35% by weight of the metal working fluid.

12. The metalworking fluid according to claim 10, wherein the metalworking fluid is in the form of a water-in-oil emulsion or an oil-in-water emulsion.

13. A method of cutting, grinding or cleaning a metal, the method comprising applying a metalworking fluid according to claim 10 to said metal; and cutting, grinding or cleaning the metal while the metalworking fluid is in contact with said metal.

14. The metalworking fluid according to claim 10, wherein the metalworking fluid comprises water and an oil.

15. A method for making a metalworking fluid, comprising providing a metalworking fluid, and adding the industrial fluid additive composition according to claim 1 to the metalworking fluid.

16. A metalworking fluid comprising:

water and an oil;

one or more compounds of formula (A):

(A)

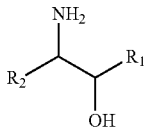

present in an amount in the range of from 0.1% to 0.5% by weight of the fluid;

wherein $R_1$ and $R_2$ are independently selected from unsubstituted alkyl moieties containing from 1 to 5 carbon atoms, and wherein the compound of formula (A) contains from 5 to 12 carbon atoms; and one or more sequestering agents comprising a compound of formula (B):

(B)

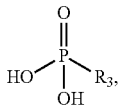

wherein $R_3$ is a substituted alkyl group comprising one or two carbon atoms and one or two phosphonate moieties, present in an amount of from 0.01% to 0.15% by weight of the fluid.

* * * * *